US007165614B1

(12) United States Patent
Bond

(10) Patent No.: US 7,165,614 B1
(45) Date of Patent: Jan. 23, 2007

(54) REACTIVE STIMULATION OF OIL AND GAS WELLS

(76) Inventor: Lesley O. Bond, 707 Peterson Rd., Neosho, MO (US) 64850

( * ) Notice: Subject to any disclaimer, the term of this patent is extended or adjusted under 35 U.S.C. 154(b) by 0 days.

(21) Appl. No.: 11/160,397

(22) Filed: Jun. 22, 2005

Related U.S. Application Data

(63) Continuation-in-part of application No. 10/782,336, filed on Feb. 19, 2004.

(60) Provisional application No. 60/502,703, filed on Sep. 12, 2003.

(51) Int. Cl.
*E21B 29/00* (2006.01)

(52) U.S. Cl. ..... 166/297; 175/4.6

(58) Field of Classification Search ..... 175/4.6, 175/4.57, 3.5; 166/247, 55.1, 297; 507/276; 102/476, 306, 307–310
See application file for complete search history.

(56) References Cited

U.S. PATENT DOCUMENTS

| | | | | |
|---|---|---|---|---|
| 2,640,547 | A | | 6/1953 | Baker et al. |
| 2,656,003 | A | | 10/1953 | Poulter |
| 2,831,429 | A | | 4/1958 | Moore |
| 2,935,020 | A | | 5/1960 | Howard et al. |
| 3,013,491 | A | | 12/1961 | Poulter |
| 3,727,690 | A | | 4/1973 | Munson |
| 3,791,255 | A | | 2/1974 | Fox et al. |
| 3,948,181 | A | | 4/1976 | Bergstrom |
| 3,967,553 | A | | 7/1976 | Keraus et al. |
| 4,039,361 | A | | 8/1977 | Ray et al. |
| 4,160,412 | A | | 7/1979 | Snyer et al. |
| 4,237,787 | A | | 12/1980 | Wacula et al. |
| 4,254,828 | A | | 3/1981 | Sowa et al. |
| 4,305,463 | A | | 12/1981 | Zakiewicz |
| 4,391,337 | A | * | 7/1983 | Ford et al. ..... 175/4.6 |
| 4,456,492 | A | | 6/1984 | Alexander et al. |
| 4,499,945 | A | | 2/1985 | Hill et al. |
| 4,519,453 | A | | 5/1985 | Riddiford |
| 4,581,082 | A | | 4/1986 | Hagel et al. |
| 4,658,916 | A | | 4/1987 | Bond |
| 4,669,542 | A | | 6/1987 | Venkatesan |
| 4,728,376 | A | | 3/1988 | Kurtz |
| 4,744,909 | A | * | 5/1988 | Ferraro et al. ..... 210/747 |
| 4,824,495 | A | | 4/1989 | Verneker |
| 5,045,046 | A | | 9/1991 | Bond |
| 5,259,317 | A | | 11/1993 | Lips |
| 5,346,014 | A | | 9/1994 | Ross |
| 5,421,418 | A | * | 6/1995 | Nelson et al. ..... 175/2 |
| 5,452,763 | A | | 9/1995 | Owen |
| 5,859,383 | A | * | 1/1999 | Davison et al. ..... 102/307 |

(Continued)

*Primary Examiner*—William Neuder
*Assistant Examiner*—Nicole Coy
(74) *Attorney, Agent, or Firm*—Mary M. Lee

(57) ABSTRACT

A method and apparatus for stimulating producing strata in oil or gas wells. The formation is penetrated using shaped charges, and an oxygen-rich material then is introduced into the producing formation. Thus, oxygen is available within the formation to sustain an explosive reaction with the existing formation hydrocarbons acting as fuel. This explosive reaction will cause fracturing of the formation and will counteract plugging that often results from the use of conventional shaped charges. In one embodiment, a container encloses shaped charges surrounded by oxygen-rich material. Alternately, the oxygen can be a part of the shaped charge and projected into the formation with the shaped charge to accomplish the same results. Still further, oxygen-rich material can be pumped into the well in bulk in a liquid or paste form.

28 Claims, 11 Drawing Sheets

U.S. PATENT DOCUMENTS 5,868,202 A 2/1999 Hsu
5,957,196 A 9/1999 Gibson et al.
6,009,946 A 1/2000 McKelvey
6,276,453 B1 8/2001 Bond
6,336,506 B1 * 1/2002 Wesson ..... 166/308.1
6,571,867 B1 6/2003 Bond
2003/0037692 A1 * 2/2003 Liu ..... 102/301

* cited by examiner

REACTIVE STIMULATION OF OIL AND GAS WELLS

CROSS-REFERENCE TO RELATED APPLICATIONS

This application is a continuation-in-part of co-pending application Ser. No. 10/782,336, entitled "Reactive Stimulation of Oil and Gas Wells," filed Feb. 19, 2004, which claims the benefit of the filing date of provisional application Ser. No. 60/502,703, entitled "Reactive Stimulation of Oil and Gas Wells," filed Sep. 12, 2003. The contents of these prior applications are incorporated herein by reference.

FIELD OF THE INVENTION

The present invention relates to methods and devices for stimulating producing formations in oil and gas wells to increase production.

BACKGROUND OF THE INVENTION

The quantity of oil and gas production from a hydrocarbon bearing strata into a borehole is influenced by many physical factors. Darcey's flow equation, which defines flow in a well, takes into account the reservoir constants of temperature, viscosity, permeability, reservoir pressure, pressure in the borehole, thickness of the producing strata, and the area exposed to flow.

It has long been known that increasing the exposed flow area in a producing well increases production. For example, it is known that drilling a larger diameter hole exposes more of the producing strata and thus increases production.

Enlarging the flow areas in open hole intervals has been accomplished by using both explosives and chemicals. However, use of these agents is somewhat limited where the producing strata are cemented behind steel casing. In cased applications, the well is "perforated" to create small holes that extend through the steel casing, the annulus cement and the adjacent formation.

Prior to the invention of the shaped charge, wells were perforated with multiple, short-barreled guns. The bullets penetrated the casing, the annulus cement, and the producing strata. The shaped charge, with its greater penetration and reliability, though, has largely replaced the so-called "bullet guns."

A shaped charge makes a hole through the casing and into the strata by forming a high speed stream of particles that are concentrated in a small diameter jet. As the high energy particles hit solid material, the solid material is pulverized. Thus, shaped charges can be used to place numerous small perforations where desired in a well. However, the fine material from the pulverized rock and the shaped charge particles can have a detrimental effect on fluid flow in the area around the perforation. Debris from the spent charge as well as fragments and particles from the pulverized formation tend to plug the perforations and obstruct passages in the fractured formation.

The formation pressure acts on the small oil droplets in the formation to force the hydrocarbons from the connected pore spaces into the well bore. The magnitude of the area in the formation exposed by the perforations directly affects the amount of flow and/or work required for that production. Accordingly, increasing the exposed flow area by perforation does two favorable things: it increases the flow rate directly, and, it reduces the amount of work required to maintain a given production rate. Increasing the flow area in a well increases the ultimate recovery from the well/reservoir by conserving formation pressure or reservoir energy.

The present invention provides a method and apparatus capable of increasing the exposed surface area in a formation when using shaped charges to perforate a well. This apparatus and method augment the use of shaped charges by introducing oxygen rich material into the formation with the explosive. The delivery of an oxygen source to the hydrocarbon-containing formation, in the presence of the explosive reaction, provides sustained explosive burning of the hydrocarbons in the vicinity of the perforation. The burning in the formation continues until the oxygen-rich material is depleted, then the burning self-extinguishes. Thus, the extent of the burning can be controlled by selecting the amount of oxygen-rich material to be introduced into the formation.

This significant secondary reaction in the strata has two beneficial effects. In the first place, the reaction will cause a cleaning effect on the fine particles that might otherwise plug the perforation. The cleaning effect occurs when the explosive burning causes high pressure gases to be generated, and these pressurized gases are discharged rapidly back into the borehole or casing. Secondly, the extended burning or explosion in the treated stratum causes further fracturing of the formation. This results in further expansion of the exposed flow areas in the formation beyond the initial shaped charge perforation. In addition, in the event the strata being perforated are water bearing, the explosive reaction will not occur; rather, only oil or gas bearing formations will be stimulated.

SUMMARY OF THE INVENTION

The present invention is directed to an apparatus for stimulating production from a hydrocarbon-containing formation in an oil or gas well. The apparatus comprises a container sized to be received and supported in the well at a level adjacent the formation. At least one shaped charge is supported within the container. The shaped charge is adapted, when ignited, to perforate the formation and to initiate a burn of hydrocarbons therein. The apparatus includes a supply of oxygen-rich material supported within the container and adapted to be introduced explosively into the formation with the shaped charge. In this way, the burn of hydrocarbons therein is extendable. The apparatus further includes at least one igniter for detonating the shaped charge.

Still further, the present invention comprises a method for stimulating production from a hydrocarbon?containing formation in an oil or gas well. The method comprises perforating the formation using a shaped charge and introducing an oxygen?rich material to the formation. Thus, the burn of the hydrocarbons is enhanced.

DETAILED DESCRIPTION OF THE PREFERRED EMBODIMENT(S)

Figure 1:
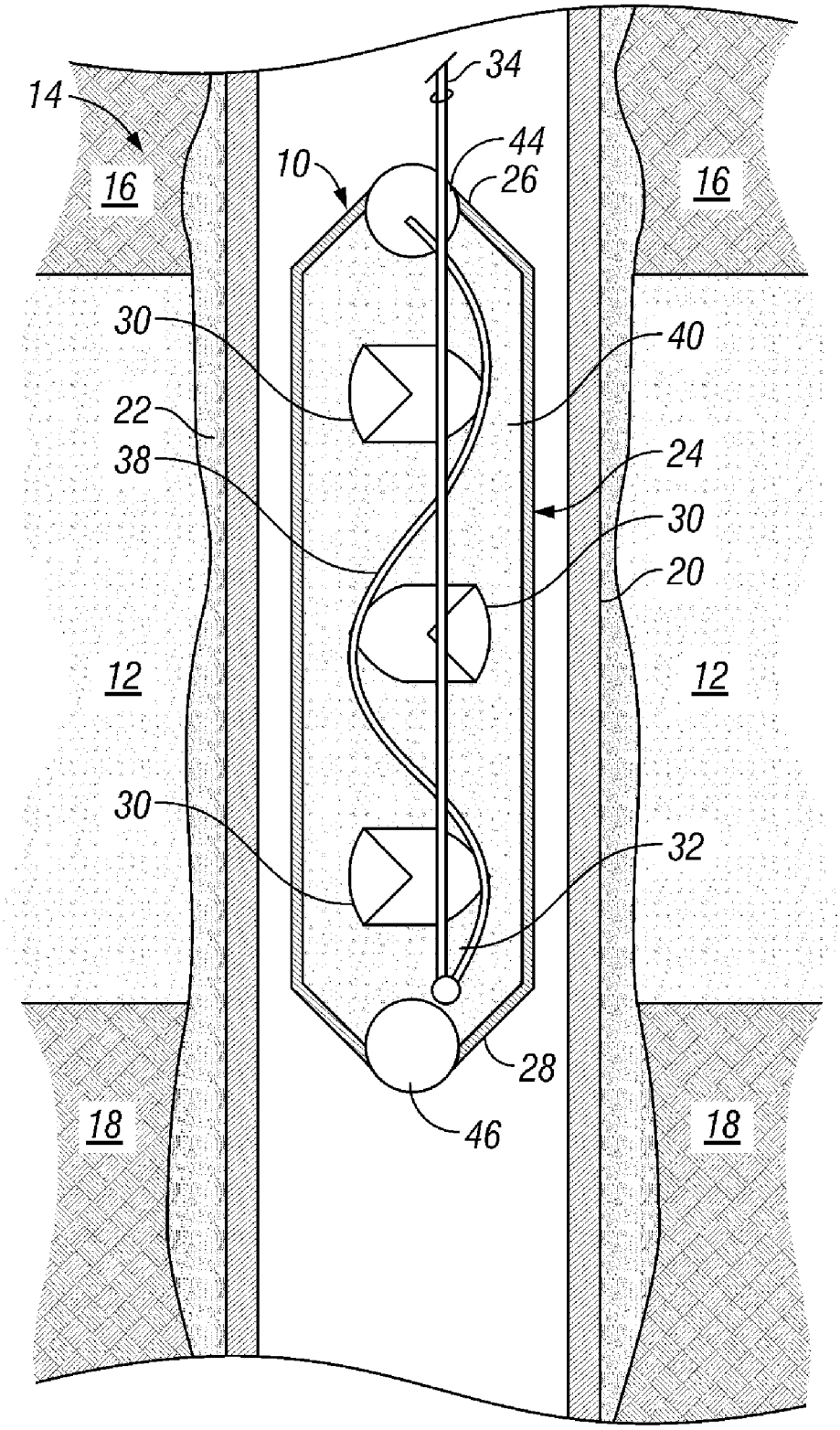
FIG. 1 is a longitudinal section view of an apparatus in accordance with a first embodiment of the present invention. The apparatus is shown positioned at the level of a target formation in an oil or gas well.

With reference now to the drawings in general and to FIG. 1 in particular, there is shown therein an apparatus constructed in accordance with a first preferred embodiment of the present invention and designated generally by the reference numeral 10. The apparatus 10 is adapted to stimulate production from a hydrocarbon-containing formation or strata 12 in an oil or gas well 14.

An illustrative well environment is shown in FIG. 1 and comprises shale zones 16 and 18 above and below the formation 12. In most instances, the apparatus 10 will be used in a cased interval of the well 14, and the casing of the well 14 is indicated at 20 with the cement in the annulus designated at 22.

The apparatus 10 comprises a container 24 sized to be received and supported in the well 14 at a level adjacent the formation 12. Preferably, the container 24 is elongated having first and second ends 26 and 28.

The apparatus 10 further comprises at least one shaped charge supported within the container 24. The shaped charge is adapted, when ignited, to perforate the formation. Preferably, there is a plurality of shaped charges that can be positioned to perforate different locations in the formation 12. More preferably, there are three shaped charges, such as the charges 30.

Figure 9:
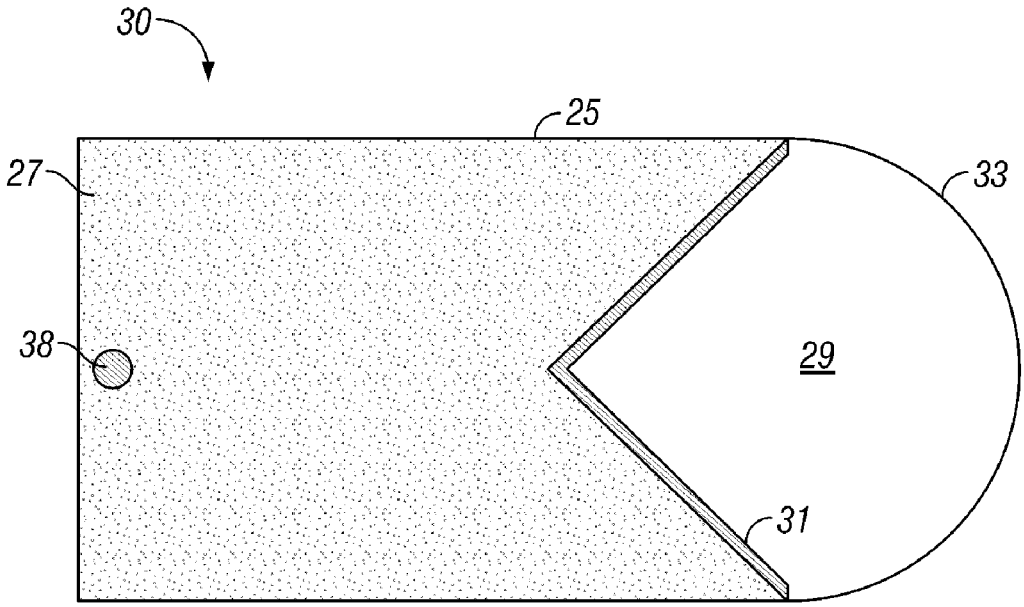
FIG. 9 (Prior Art)
FIG. 9 is a sectional view of a conventional shaped charge.

This embodiment may use conventional shaped charges, one example of which is seen in FIG. 9. As shown, a typical shaped charge 30 comprises a cylindrical metal housing 25, usually made of aluminum or steel. The housing 25 is filled with a high explosive 27. The front end of the explosive 27 is pressed into a conically shape recess 29, which is fitted with and correspondingly shaped metal liner 31. The liner usually is made of copper or a copper alloy. The housing 25 usually is formed into a domed front end 33 to prevent any liquid or other matter from interfering with the formation of the jet from the charge.

With continuing reference to FIG. 1, an igniter of some sort is provided to detonate the shaped charges 30. In the preferred embodiment of FIG. 1, the igniter comprises an electrical igniter 32 disposed within container 24. The igniter 32 is electrically connected to a conductor wire 34 which extends from the apparatus 10 to the well head (not shown). As shown here, the conductor wire 34 may be used to suspend the apparatus 10 in the well 14.

Extending from the igniter 32 is a primer cord 38. Preferably, the primer cord comprises a high order explosive, and is crimped into and made a part of the igniter 32. The primer cord 38 connects to the shaped charges 30 in series. Thus, when the igniter 32 is initiated by a signal from the surface through the conductor wire 34, the shaped charges 30 will be ignited by the fast burning primer cord 38, which runs from the igniter 32 to the uppermost shaped charge 30 in the plurality of charges.

Referring still to FIG. 1, the apparatus 10 preferably also includes a supply of oxygen-rich material supported within the container 24 and adapted to be introduced explosively into the formation 12 with the shaped charges, such as the charges 30. This will provide a source of oxygen to support explosive burning of the hydrocarbons in the formation.

In the embodiment of FIG. 1, the oxygen-rich material 40 in the container 24 is external to and surrounds the shaped charges 30. Preferably, the oxygen-rich material 40 is potassium nitrate. However, the other materials such as ammonium nitrate may be utilized in addition to or instead of potassium nitrate. As used herein, "oxygen-rich material" denotes any material capable of releasing oxygen when activated.

To propel the oxygen-rich material 40 through the perforations behind the shaped charges 30, the apparatus is provided with separate delivery explosives in the form of end charges 44 and 46. The end charges 44 and 46 preferably are composed of a slow burning (low order) explosive and may be positioned at the first and second ends 26 and 28, respectively, of the container 24. When thus arranged, it is convenient to attach the primer cord 38 to the end charges 44 and 46, as shown in FIG. 1. Thus, a single signal on the conductor wire 34 to the igniter 32 will ignite the end charges 44 and 46 as well as the shaped charges 30 via the primer cord 34.

The end charges 44 and 46, positioned at each end of the supply of oxygen-rich material 40, will create very high pressures momentarily inside the container 24 and the well casing 20. This pressure will force the oxygen-rich material 40 out through the perforations in the casing 20, the annulus cement 22, and into the surrounding formation 12 immediately behind the shaped charges 30. This, in turn, causes explosive burning of the hydrocarbons in the formation 12 that is supported by the oxygen being released by the oxygen-rich material 40.

The operation of the apparatus of FIG. 1 is explained with reference to the diagram in FIG. 2. At Time Zero, the signal from the conductor wire 34 triggers the igniter 32 (FIG. 1), which in turn initiates the explosive reaction in the fast burning primer cord 38 that runs the length of the container 24. The reaction time of the igniter 32 is shown at 50 on the time graph in FIG. 2. The spike has a duration of about 0.0500 milliseconds, and the total reaction time of the igniter is about 0.200 milliseconds.

The igniter 32 initiates the reaction in the fast burning primer cord 38. Being a fast burning explosive, the cord 38 burns from the igniter to the cord end very rapidly, for a duration of about 0.500 milliseconds indicated at 52 in FIG. 2. The preferred primer cord 38 burns at about 20,000 feet per second. Thus, the primer cord 38 could travel a 10-foot string of 40 shaped charges, for example, in only about 0.500 milliseconds.

The primer cord 38 ignites the shaped charges 30, the oxygen-rich material 40, and the low order explosives in the end charges 44 and 46. Due to fast burning (high order) explosives in the shaped charges 30, the shaped charges burn rapidly for about 0.100 milliseconds as indicated at 54. However, the much slower burning oxygen-rich material 40 and the end charges 44 and 46 burn for a much longer duration, about 4.000 milliseconds and about 5.000 milliseconds at 56 and 58, respectively.

Figure 2:
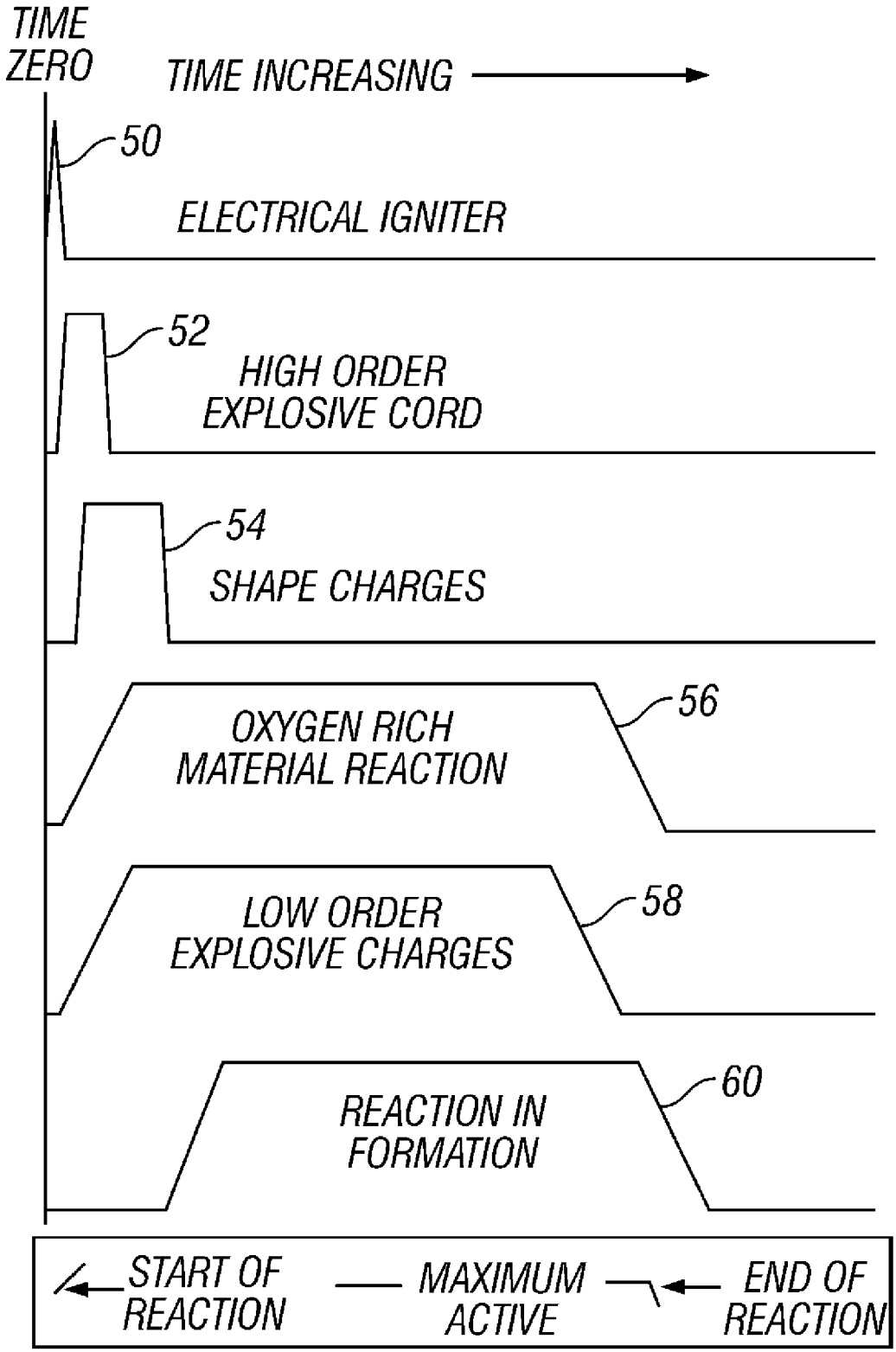
FIG. 2 is a schematic diagram illustrating the timing of the sequence of events produced by the apparatus of FIG. 1.

Referring still to FIG. 2, the secondary reaction in the formation comprising the sustained burning of the hydrocarbons lasts until the oxygen-rich material 40 is depleted, as indicated at 60. The total duration of the reactive explosion of hydrocarbons and oxygen in the formation, therefore, begins shortly after the introduction of oxygen in the perforated hole and into the formation and expires as the pyrotechnic reactions stop for lack of oxygen or other reagents.

Figure 3:
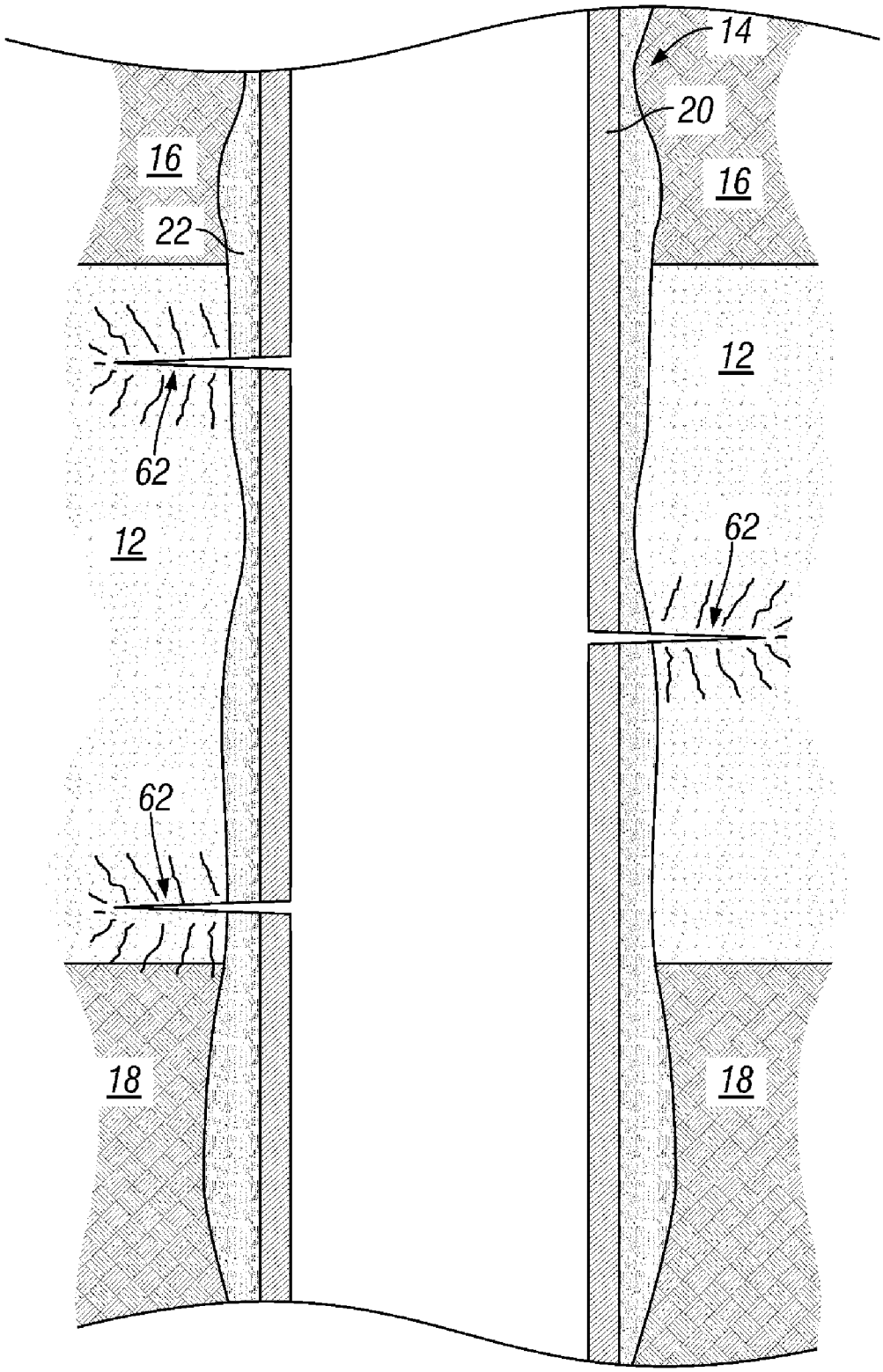
FIG. 3 is a fragmented sectional view of the target formation shown in FIG. 1 after completion of the stimulation treatment.

The effect of the operation of the apparatus 10 is illustrated in FIG. 3, to which attention now is directed. This drawing illustrates the condition of the well after ignition of the apparatus 10. The container 24 and its components are substantially destroyed, leaving perforations 62 corresponding to the positions of the shaped charges 30. The sustained, explosive burn of the hydrocarbons in the formation surrounding the perforations 62 has substantially increased the surface area for production by fracturing and cleaning the formation.

Figure 4:
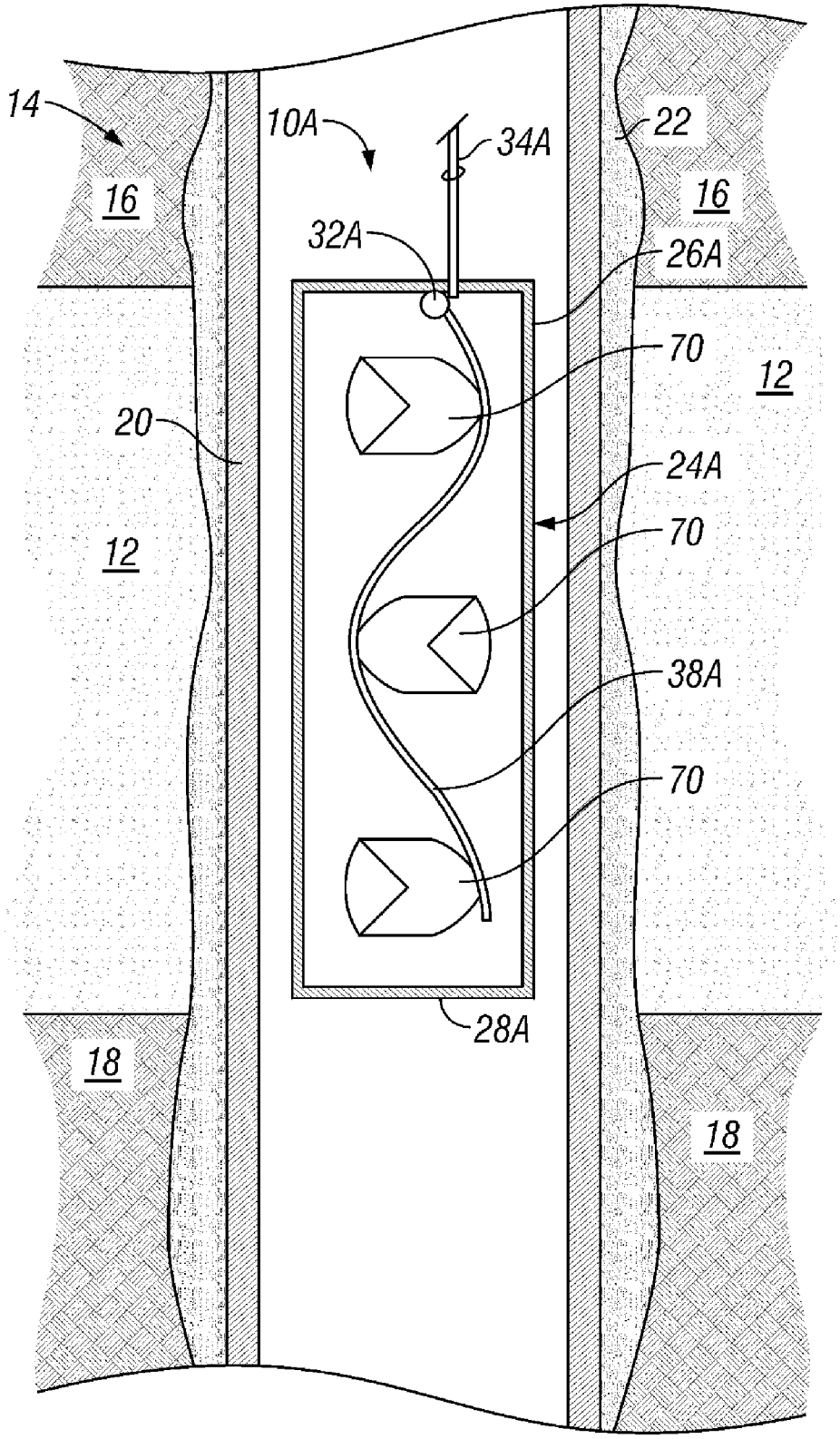
FIG. 4 is a longitudinal sectional view of an apparatus in accordance with a second embodiment of the present invention positioned at the level of a target formation in an oil or gas well.

Shown in FIG. 4 is another preferred embodiment of the apparatus of the present invention. In this embodiment, the apparatus 10A comprises an elongated container 24A having first and second ends 26A and 28A. The container 24A is suspended by a conductor wire 34A similar to the corresponding components of the apparatus 10 of FIG. 1. An electrical igniter 32A, which may be similar to the igniter 32 of the previous embodiment, is supported near the first end 26A of the container 24A.

At least one and preferably three shaped charges 70 are supported inside the container 24A. As in the previous embodiment, the shaped charges 70 preferably are connected in series to a primer cord 38A, which is connected to the igniter 32A. Generally, it is desirable to average about four shaped charges per foot.

Figure 5:
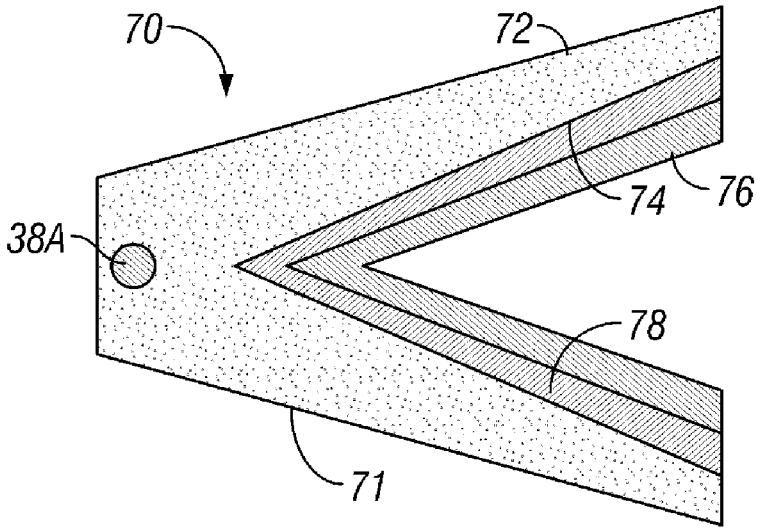
FIG. 5 is a sectional view of a shaped charge made in accordance with one embodiment of the present invention.

The apparatus 10A also includes a supply of oxygen-rich material. However, in this embodiment, the oxygen-rich material is contained in the shaped charges 70, shown in enlarged form in FIG. 5. The "oxygenated" shaped charge 70 of comprises a housing 71 containing a body of high explosive 72 formed to have a conically shaped frontal recess 74.

A detonator is included in the shaped charge 70 to ignite the body of explosive 72. The detonator may be the primer cord 38A running therethrough.

A liner 76, usually of copper, is included. The liner 76 is shaped to line the frontal recess 74 in the body of explosive 72. Thus, the liner 76 in this configuration is conical.

Still further, a layer of oxygen-rich material 78 is included in the shaped charge 70. In the preferred form, the oxygen-rich layer 78 is positioned between the conical copper liner 76 and the conical frontal recess 74 of the body of explosive 72. The conically shaped oxygen-rich material 78 and the conically shaped copper liner 76 thus form a bimetallic liner for the shaped charge 70.

After the primer cord 38A ignites the high explosive 72, the rapid burning of explosive 72 will convert the conically shaped copper liner into a rapidly moving jet that will perforate the casing and the formation (neither shown in this Figure). At the same time, the conically shaped oxygen-rich layer 78 will also be converted into a slower moving slug of oxygen-rich material. This slower moving slug follows the rapidly moving jet into the formation where, in the presence of the jet and the hydrocarbons in the formation, the oxygen-rich slug will support an extended burn of the hydrocarbons.

Figure 6:
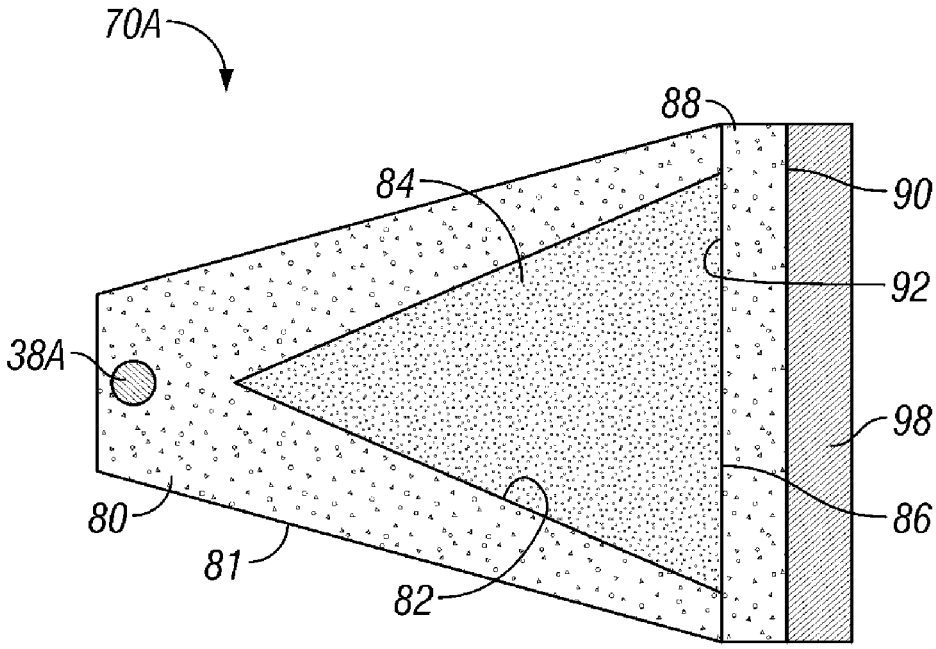
FIG. 6 is a sectional view of a shaped charge made in accordance with a second embodiment of the present invention.

Shown in FIG. 6 is second embodiment of an oxygenated shaped charge in accordance with the present invention designated as 70A. In this embodiment, the shaped charge 70A comprises a conically shaped body of fast burning explosive 80 in a housing 81. The recess 82 is also conical in shape. A detonator is included, such as the primer cord 38A, to ignite the fast burning explosive 80.

The shaped charge 70A further comprises a conically shaped insert 84 of slower burning (lower order) explosive. The insert 84 is shaped to conform to and be received in the frontal recess 82 of the body 80. Thus, the insert 84 in the embodiment shown is conically shaped. Further, the insert 84 is shaped to have a planar front 86.

Referring still to FIG. 6, the shaped charge 70A comprises a disc shaped layer 88 of fast burning explosive. The fast burning layer 88 has a front 90 and a rear 92. The rear 92 is fixed to the planar front 86 of the insert 84.

Still further, the shaped charge 70A includes a disc shaped layer 98 of elastic material molded at high pressure to contain an oxygen-rich material, such as potassium nitrate fixed on the front of the fast burning layer 88.

It is now seen that, when the shaped charge 70A is detonated, the oxygen?rich disk 98 will be propelled through the casing 20 and cement annulus 22. The initial movement of the disc of oxygen-rich material 98 will be ahead of the shaped charge jet. However, the shaped charge jet will quickly pierce the disc of oxygen-rich material 98 and will proceed to make the perforation through the casing 20 and cement annulus 22. The solid oxygen-rich disk 98 becomes a projectile that follows the jet into the perforation tunnel. The disk 98 supports the combustion of hydrocarbons in the formation ignited by the jet for the selected duration.

Figure 7:
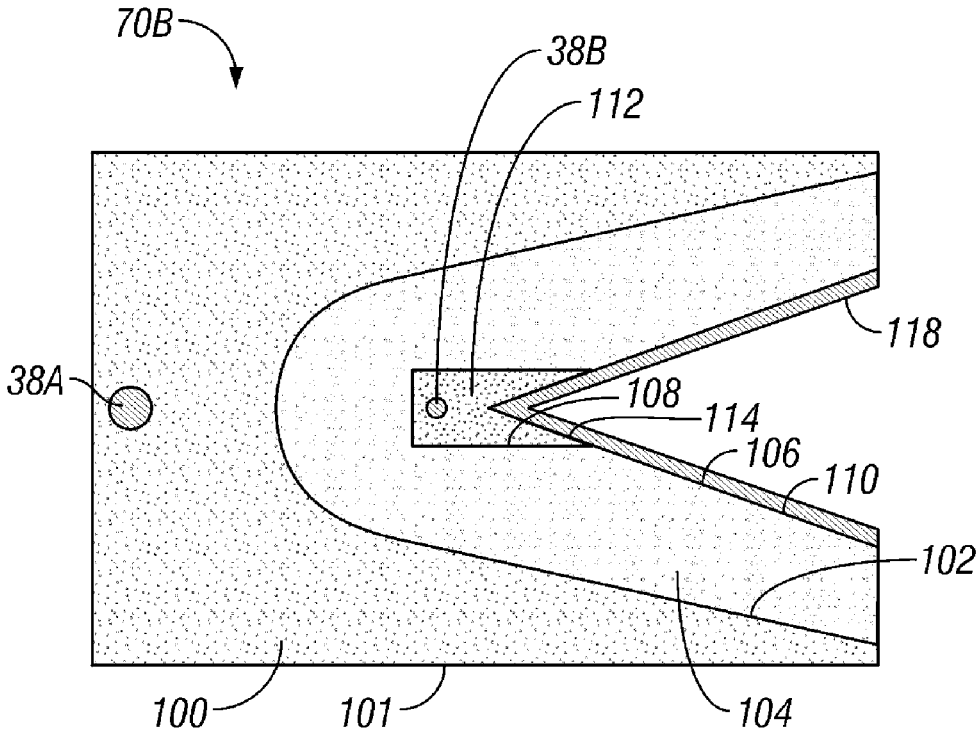
FIG. 7 is a sectional view of a shaped charge made in accordance with a third embodiment of the present invention.

Turning now to FIG. 7, another embodiment of the "oxygen-loaded" shaped charge will be described. This embodiment, designated generally by the reference numeral 70B, comprises a first body 100 of fast burning explosive in a housing 101. The fast burning explosive 100 is formed to have a frontal recess 102. Preferably, the frontal recess 102 is generally conical in shape and the apex is curved or domed instead of pointed.

Also included is a body of oxygen-rich material 104, such as potassium nitrate, formed to be received in the frontal recess 102 of the first body of explosive 100 and to have a frontal recess 106. The frontal recess 106 has a cylindrical center portion 108 and a frusto-conical forward portion 110.

Still further, the shaped charge 70B comprises a second body 112 of fast burning explosive shaped to conform to and be received in the cylindrical center 108 of the recess 102 in the body of oxygen-rich material 104. The second body 112 is also shaped to have a conical front recess 114 continuous with the frusto-conical forward portion 110 of the frontal recess 106 in the body of oxygen-rich material 104. In this way, the frontal recess 114 of the second body of explosive 112 and the frusto-conical portion 110 of the frontal recess 106 in the oxygen-rich material 104 form a complete cone.

The charge 70B includes detonators, such as the primer cords 38A and 38B, adapted to ignite the first body of fast burning explosive 100 and the second body of fast burning explosive 112. A conically shaped metal liner 118 is positioned inside the complete cone formed by the frontal recess 114 of the second body of explosive 104 and the frusto-conical portion 110 of the frontal recess 106 in the oxygen-rich material 104.

The primer cords 38A and 38B ignite the first and second bodies of fast burning explosives 100 and 112. Then, the second body of high order explosive 112 will collapse the liner 118 to form a high velocity jet which will penetrate the casing, cement, and formation. Concurrently, the first body of high order explosive 100 propels the oxygen rich material 104 into the perforation tunnel in time to support the reaction of the jet and the hydrocarbons in the formation.

Figure 8:
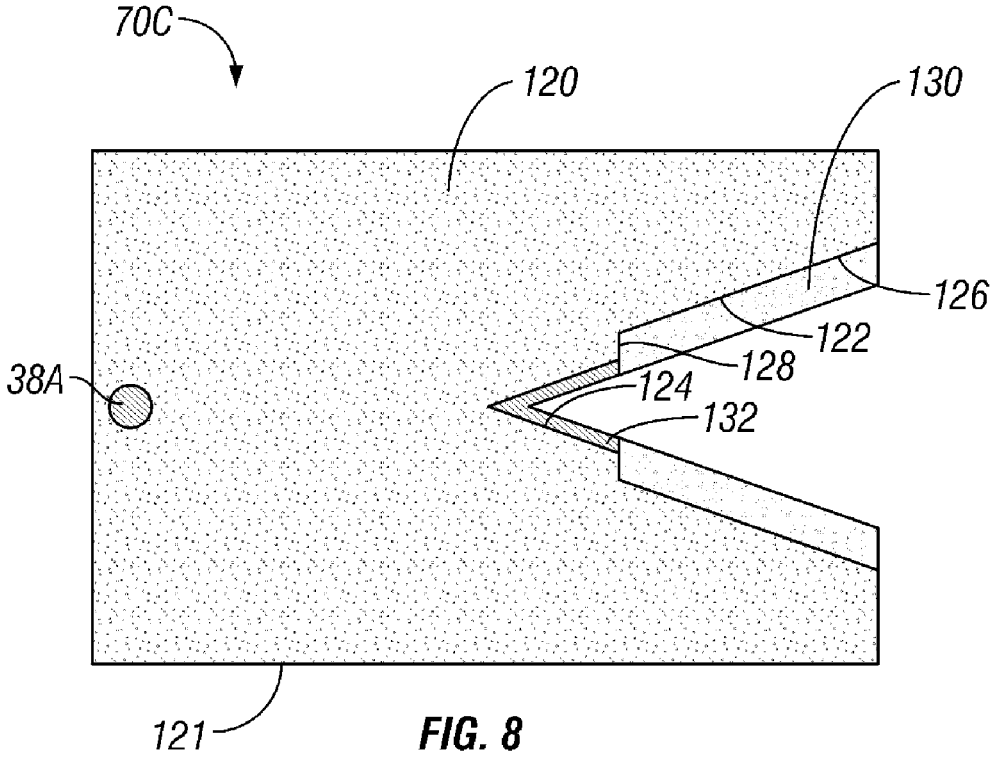
FIG. 8 is a sectional view of a shaped charge made in accordance with a fourth embodiment of the present invention.

With reference now to FIG. 8, yet another embodiment of a shaped charge will be described. This shaped charge, designated generally as 70C, comprises a body of fast burning explosive 120 in a housing 121. The body of explosive 120 is formed to have a stepped frontal recess 122 with a conical center portion 124 and a frusto-conical forward portion 126. The narrowest diameter of the forward portion 126 forms a step 128 between the center portion 124 and the forward portion 126.

The charge 70C further comprises a body of oxygen-rich material 130 formed to be received in frusto-conical forward portion 126 of the frontal recess 122 of the body of explosive 120. The narrowest diameter of the body of oxygen-rich material 130 is substantially the same as the widest diameter of the center portion 124 of the frontal recess 122 of the body of fast burning explosive 120. Thus, the conical center portion 124 of the frontal recess 122 of the body of explosive 120 and the body of oxygen-rich material 130 form a complete cone.

A detonator, such as the primer cord 38A is adapted to ignite the body of fast burning explosive 120. Also, included is a conically shaped liner 132 positioned inside the conical center portion 124 of the frontal recess 122 in the body of fast burning explosive 120.

The primer cord 38A ignites the body of fast burning explosives 120. Then, the liner 132 and a small part of the oxygen rich material 126 will collapse into a high velocity jet that will penetrate the casing, cement, and formation. The remaining oxygen rich material 126 will form a slower moving slug that will enter the perforation tunnel in time to support the reaction of the jet and the hydrocarbons in the formation.

As indicated above, FIG. 9 shows an example of a conventional shaped charge 30 used in well perforating procedures. FIGS. 10–14 illustrate various modifications of the conventional charge to include a supply of oxygen-rich material. In each of these embodiments, the shaped charge comprises a housing 140 containing a high explosive 142 with a conical recess 144 in the front covered with a metal liner 146. In each of these embodiments, the front of the charge housing 140 is formed into a dome 150 in which the oxygen-rich material is packed. Alternately, a conventional shaped charge, such as the charge 30, could be used in conjunction with a separate disk-shaped body of oxygen-rich material (not shown) positioned in front of the dome-shaped head of the charge.

Figure 10:
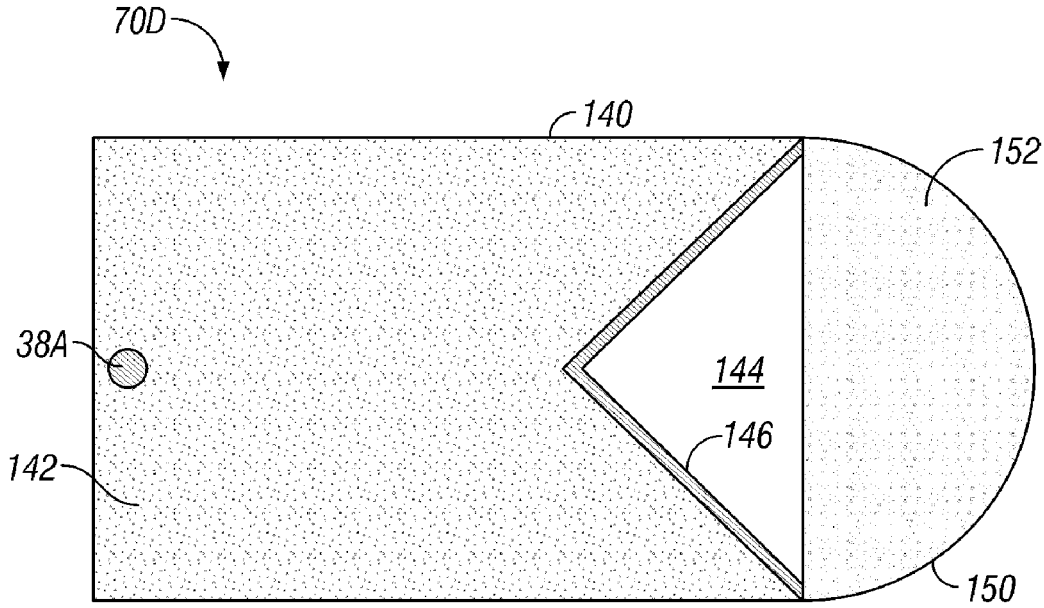
FIG. 10 is a sectional view of a shaped charge made in accordance with a fifth embodiment of the present invention.

FIG. 10 shows a shaped charge 70D in which the dome 150 is completely filled with oxygen-rich material 152 without substantial voids. Thus, in this embodiment, the oxygen-rich material is generally a solid hemisphere.

Figure 11:
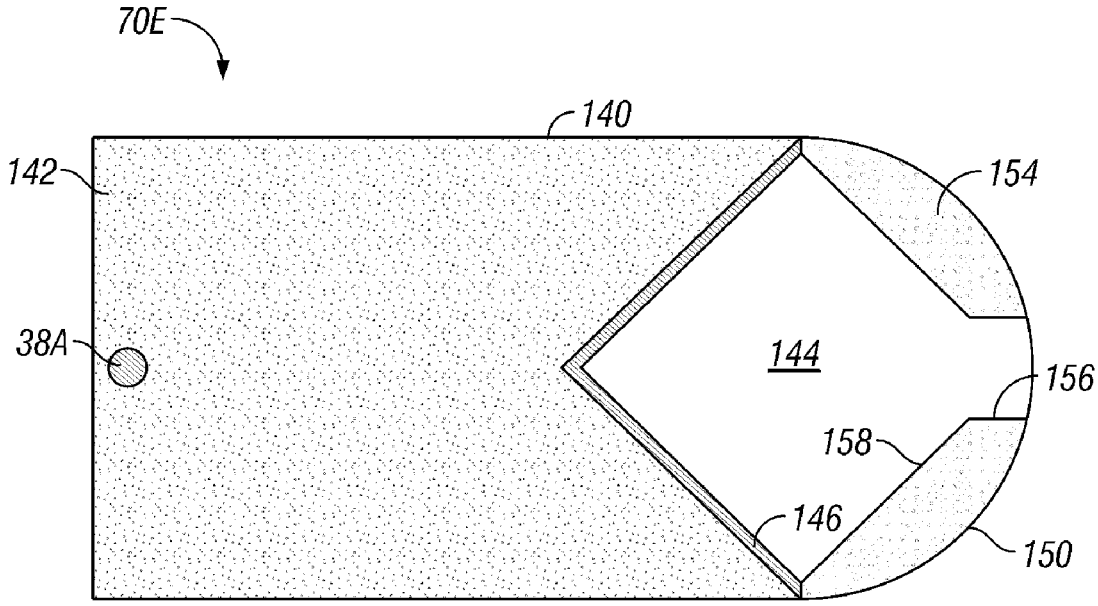
FIG. 11 is a sectional view of a shaped charge made in accordance with a sixth embodiment of the present invention.

FIG. 11 shows a shaped charge 70E in which the dome 150 is only partially packed with oxygen-rich material. Specifically, the oxygen-rich material 154 is a domed ring with a central bore 156 therethrough and with a frusto-conically shaped surface at the rear.

Figure 12:
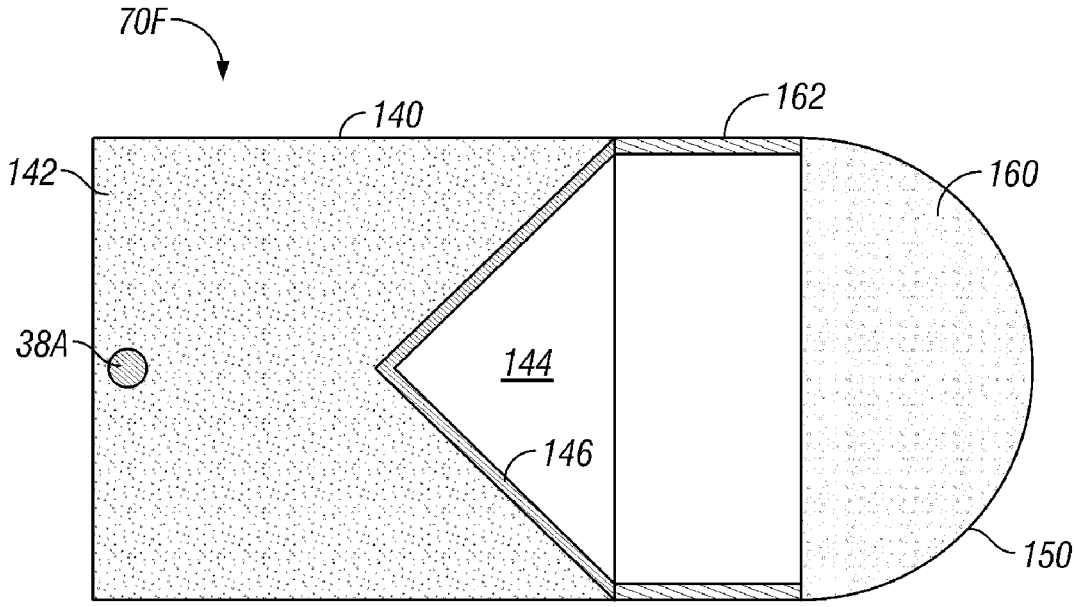
FIG. 12 is a sectional view of a shaped charge made in accordance with a seventh embodiment of the present invention.

FIG. 12 shows a shaped charge 70F with a dome 150 completely filled with oxygen rich material 160 similar to the embodiment 70D in FIG. 10. However, in this embodiment, the housing 140 extends to form an empty collar or spacer 162 between the recess 144 and the dome 150.

Figure 13:
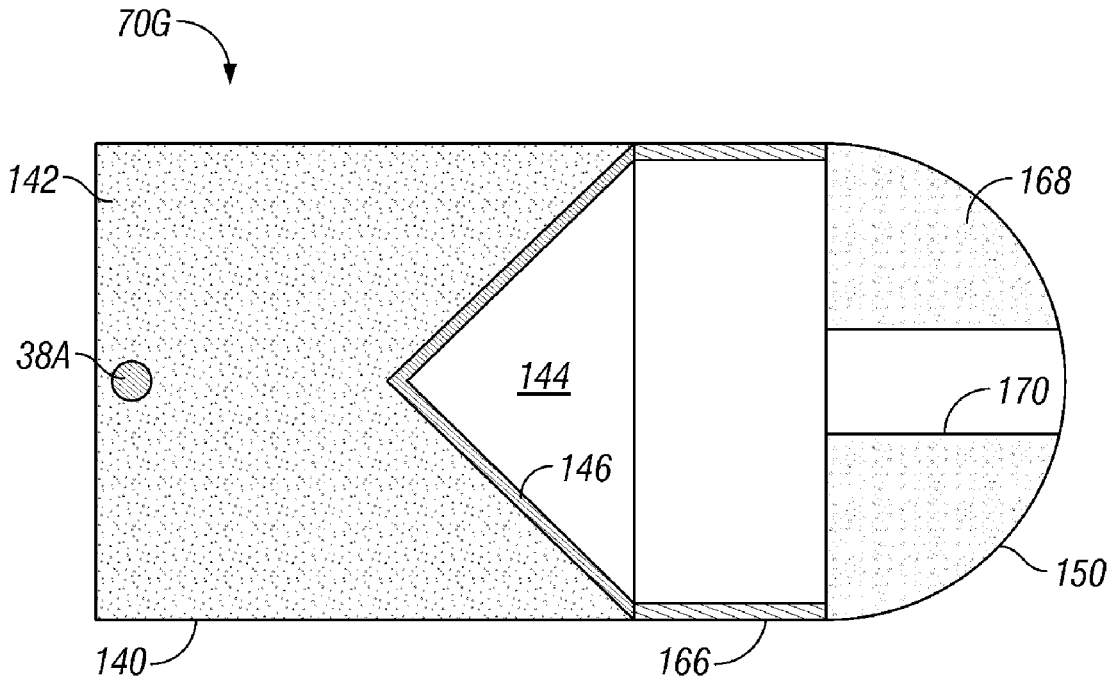
FIG. 13 is a sectional view of a shaped charge made in accordance with an eighth embodiment of the present invention.

FIG. 13 shows a shaped charge 70G similar to the charge 70F in FIG. 12 having spacer 166 between the dome 150 and the recess 144. However, in this embodiment, the oxygen-rich material 168 is shaped to form a central, cylindrical bore 170 extending therethrough.

Figure 14:
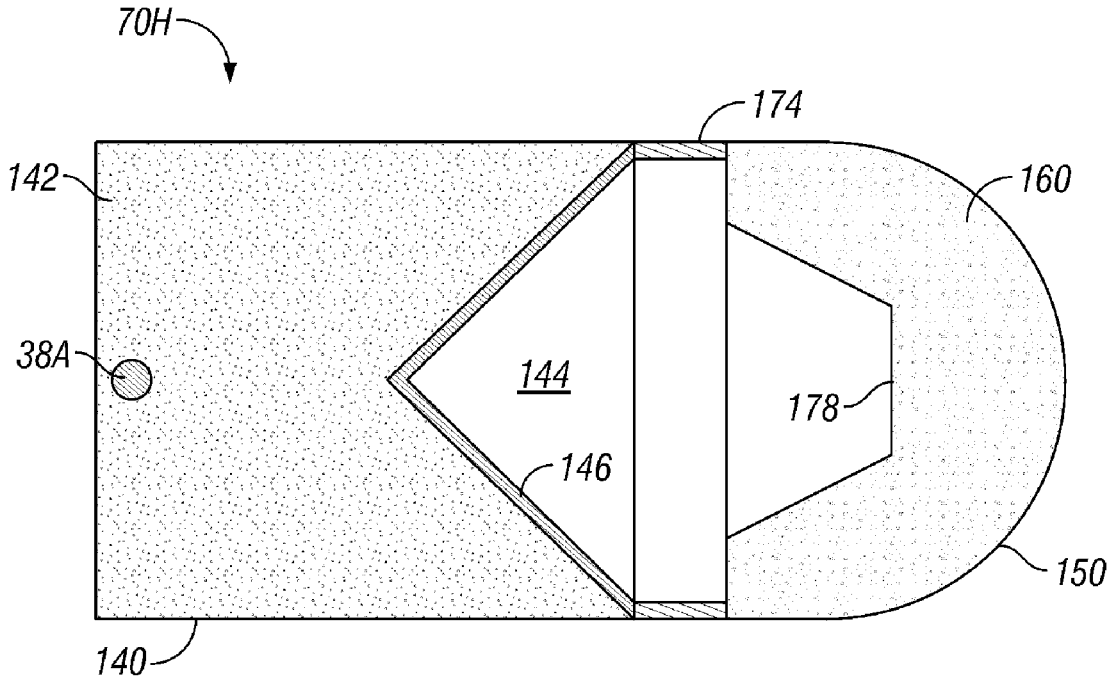
FIG. 14 is a sectional view of a shaped charge made in accordance with a ninth embodiment of the present invention.

FIG. 14 shows another shaped charge 70H with a spacer 174 similar to the spacers 162 and 166 of the charges 70F and 70G of FIGS. 12 and 13. The oxygen-rich material 176 in this charge has a rear surface 178 defining a conical frustum tapering toward the front of the dome 150 but not extending through it.

Now it will be appreciated that, in all of the embodiments of FIGS. 10–14, the oxygen-rich material is shaped and positioned so that the high explosive 142 in the housing 140 fires through the oxygen-rich material. Without wishing to be bound by theory, it is believed that the high explosive ignites or shocks the oxygen-rich material as it passes through it, turning it into gas. It may also be true that the explosive blows the dry particulate oxygen-rich material into the perforation, causing the extended burn sought to be produced. Where the oxygen-rich material is suspended in a non-aqueous or non carbon-based liquid, such as methylene chloride, the ignited charge shocks the liquid into a gas. In both cases, it is believed that the resulting gas is predominantly oxygen that will react with the oil and gas in the formation in a pyrotectic environment.

Figure 15:
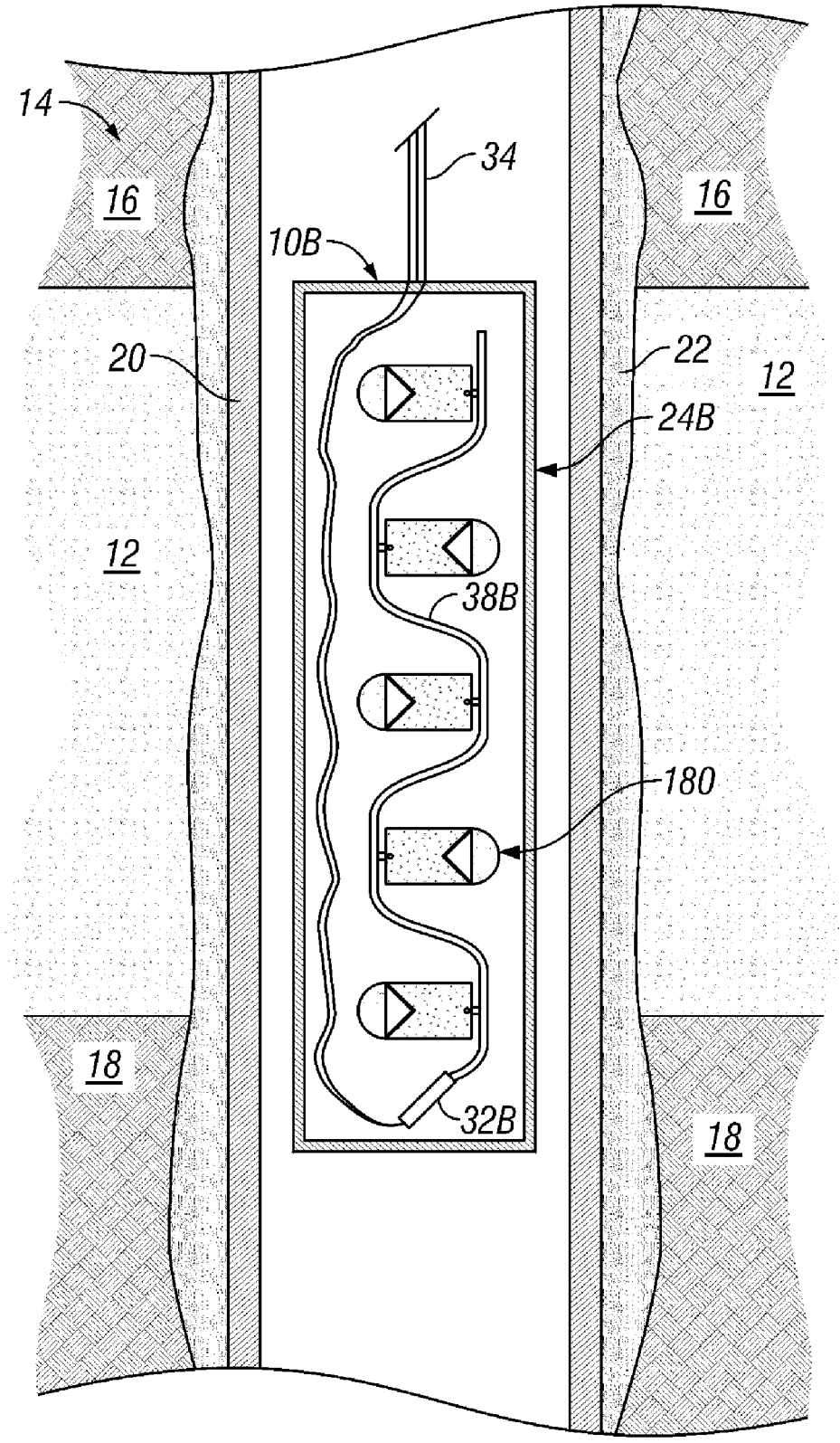
FIG. 15 is a longitudinal sectional view of an apparatus in accordance with a third embodiment of the present invention positioned at the level of a target formation in an oil or gas well.

Turning now to FIG. 15, there is shown therein another embodiment for a well stimulation apparatus, designated generally as 10B. The apparatus 10B comprises a container 24B that houses a plurality of shaped charges designated collectively at 180. The shaped charges 180 in this embodiment preferably are the modified charges containing oxygen-rich material, such as the charges 70 or 70A–70H described herein, or some combination of these. The container 24B is suspended by a conductor wire 34 that connects to an igniter 32B. A primer cord 38B extends from charge to charge as in the previous embodiments. Upon ignition, the charges 180 function in much the same manner as described previously in connection with FIG. 2 and the apparatus shown in FIG. 1, except that there is no low order explosive in this embodiment.

Figure 16:
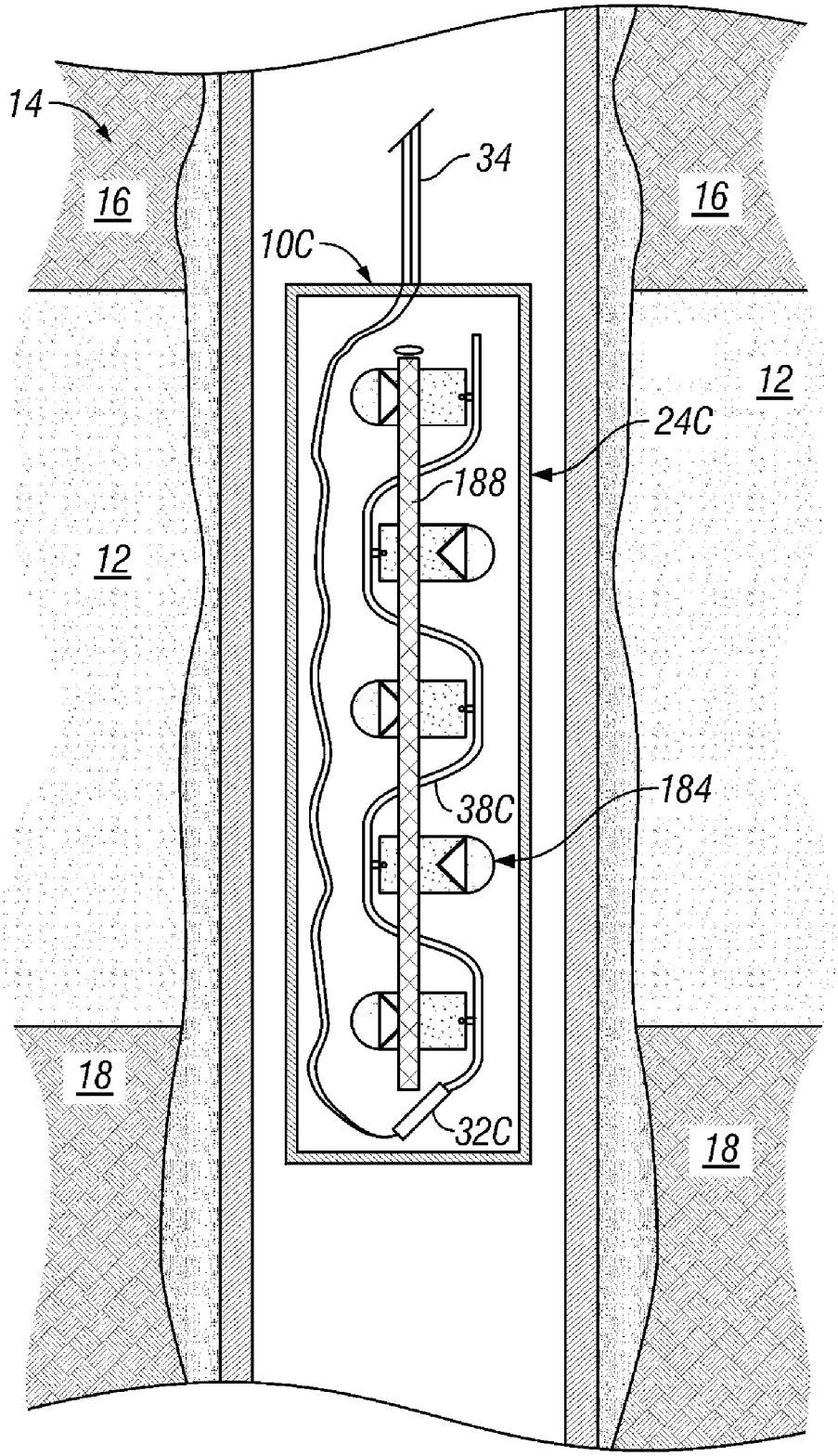
FIG. 16 is a longitudinal sectional view of an apparatus in accordance with a fourth embodiment of the present invention positioned at the level of a target formation in an oil or gas well.

Yet another embodiment of the well stimulation apparatus of this invention is shown in FIG. 16, to which reference now is made. This embodiment, designated at 10C also comprises a container 24C and a plurality of shaped charges 184. The charges are interconnected by a primer cord 38C connected at one end to an igniter 32C, which is controlled by the wires 34, as in the other embodiments. In this embodiment, additional oxygen-rich material is provided in an internal tube 188. The use of the apparatus 24C is similar to the use of the other apparatus described herein.

In accordance with the method of the present invention, there is provided a method for stimulating the hydro-carbon containing strata in an oil and gas well. In accordance with a first embodiment, the formation first is perforated. Next, an oxygen-rich material, such a potassium nitrate, is introduced into the formation to support a sustained burn of the hydrocarbons therein. This may be accomplished using one of the apparatus 10 or 10A–C comprising any combination of the shaped charges described herein. Thus, the oxygen-rich material is forced into the formation with or following the shaped charge jets.

In accordance with another embodiment of the method of this invention, oxygen-rich material may be injected non-explosively into the formation prior to the use of conventional shaped charges or any of the oxygenated shaped charges described herein. For example, it may be pumped in bulk as a paste, slurry or liquid form into the formation. One preferred method and device accomplishing this is described in U.S. Pat. No. 6,772,839, and the contents of this patent are incorporated herein by reference. Thus, the formation is impregnated with the oxygen-rich material in advance of the perforation with shaped charges, exaggerating their effects.

In another embodiment of the method of the present invention, the oxygen rich material is introduced into the producing formation by using the inventive oxygen-loaded charges to perforate the well in a conventional tubing-conveyed completion procedure. Thus, the oxygen-loaded charges may be used with or without a container in the same manner as conventional perforating charges.

In all cases, though, a supply of oxygen-rich material is dispersed through the altered formation in the presence of ignited hydrocarbons so that a sustained burn can occur. This effectively increases the exposed surface area and enhances production from the altered formation.

Changes can be made in the combination and arrangement of the various parts and elements described herein without departing from the spirit and scope of the invention as defined in the following claims.

What is claimed is:

1. An apparatus for stimulating production from a hydrocarbon-containing formation in an oil or gas well, the apparatus comprising:

a container sized to be received and supported in the well at a level adjacent the formation;

at least one shaped charge supported within the container, the shaped charge comprising:

a housing with a rear portion and a front portion;

a body of fast burning explosive in the rear portion of the housing, the front of the body defining a rearwardly pointing conical recess;

a rearwardly pointing conically-shaped liner fittingly positioned in the conical recess of the front of the body of fast burning explosive;

a detonator adapted to ignite the body of fast burning explosive; and a body of oxygen-rich material in the frontal portion of the housing in front of the body of fast burning explosive and the liner wherein the oxygen-rich material is not explosively reactive with water and that is capable of fueling the burning of hydrocarbons in the formation;

whereby the shaped charge is adapted to perforate the formation and the body of oxygen-rich material is adapted to be introduced explosively into the formation with the shaped charge whereby burning of hydrocarbons therein is promoted regardless of the presence of water in the well when the explosive is ignited;

at least one igniter for detonating the shaped charge.

2. The apparatus of claim 1 wherein the at least one shaped charge comprises a plurality of shaped charges positioned to perforate different locations in the formation.

3. The apparatus of claim 1 wherein the oxygen-rich material is potassium nitrate.

4. The apparatus of claim 3 wherein the at least one shaped charge comprises a plurality of shaped charges positioned to perforate different locations in the formation.

5. The apparatus of claim 1 wherein the apparatus further comprises a high order primer cord in contact with each of the at least one shaped charge.

6. The apparatus of claim 1 wherein the igniter is an electric igniter.

7. The apparatus of claim 1 wherein the front of the housing is dome-shaped and wherein the oxygen-rich material is generally hemispherically shaped.

8. The apparatus of claim 7 wherein the rear face of the body of oxygen-rich material is flat.

9. The apparatus of claim 8 wherein the rear face of the oxygen-rich material is adjacent the edge of the liner.

10. The apparatus of claim 8 wherein the rear face of the oxygen-rich material is spaced a distance from the edge of the liner.

11. The apparatus of claim 7 wherein the body of oxygen-rich material has a central bore therethrough.

12. The apparatus of claim 11 wherein the rear face of the body of the oxygen-rich material is flat.

13. The apparatus of claim 11 wherein the rear face of the body of the oxygen-rich material is frusto-conically shaped.

14. The apparatus of claim 7 wherein the rear face of the body of oxygen-rich material is frusto-conically shaped.

15. A shaped charge for use in perforating hydrocarbon-containing formations in oil and gas wells, the shaped charge comprising:

a housing with a rear portion and a front portion;

a body of fast burning explosive in the rear portion of the housing, the front of the body defining a rearwardly pointing conical recess;

a rearwardly pointing conically-shaped liner fittingly positioned in the conical recess of the front of the body of fast burning explosive;

a detonator adapted to ignite the body of fast burning explosive;

a body of oxygen-rich material in the front portion of the housing in front of the body of fast burning explosive and the liner wherein the oxygen-rich material is not explosively reactive with water and is capable of fueling the burning of hydrocarbons in the formation; and whereby the shaped charge is adapted to perforate the formation and the body of oxygen-rich material is adapted to be introduced explosively into the formation with the shaped charge whereby burning of hydrocarbons therein is promoted regardless of the presence of water in the well when the explosive is ignited.

16. The shaped charge of claim 15 wherein the front of the housing is dome-shaped and wherein the oxygen-rich material is generally hemispherically shaped.

17. The shaped charge of claim 16 wherein the rear face of the oxygen-rich material is flat.

18. The shaped charge of claim 17 wherein the rear face of the oxygen-rich material is adjacent the edge of the liner.

19. The shaped charge of claim 17 wherein the rear face of the oxygen-rich material is spaced a distance from the edge of the liner.

20. The shaped charge of claim 16 wherein the body of oxygen-rich material has a central bore therethrough.

21. The shaped charge of claim 20 wherein the rear face of the body of the oxygen-rich material is flat.

22. The shaped charge of claim 20 wherein the rear face of the body of the oxygen-rich material is frusto-conically shaped.

23. The shaped charge of claim 16 wherein the rear face of the body of oxygen-rich material is frusto-conically shaped.

24. The shaped charge of claim 15 wherein the oxygen-rich material is potassium nitrate.

25. A method for stimulating a hydrocarbon-containing formation in an oil or gas well, the method comprising:

non-explosively injecting a supply of oxygen-rich material into the formation;

after injecting the supply of oxygen-rich material into the formation, perforating the formation using a shaped charge.

26. The method of claim 25 wherein the oxygen-rich material is potassium nitrate.

27. The method of claim 25 wherein the shaped charge comprises:

housing with a rear portion and a front portion;

a body of fast burning explosive in the rear portion of the housing, the front of the body defining a rearwardly pointing conical recess;

a rearwardly pointing conically-shaped liner fittingly positioned in the conical recess of the front of the body of fast burning explosive;

a detonator adapted to ignite the body of fast burning explosive; and a body of oxygen-rich material in the front portion of the housing in front of the body of fast burning explosive.

28. The method of claim 25 wherein the injection step is carried out using a tubing-conveyed injection device.

* * * * *